US008245874B1

(12) United States Patent
Fowler, IV

(10) Patent No.: US 8,245,874 B1
(45) Date of Patent: Aug. 21, 2012

(54) SLIDER-HINGE DOOR

(75) Inventor: Robert J. Fowler, IV, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/068,908

(22) Filed: May 12, 2011

(51) Int. Cl.
*B65D 43/16* (2006.01)
*B65D 43/20* (2006.01)
*B65D 51/04* (2006.01)

(52) U.S. Cl. ..... 220/812; 220/345.4; 220/558; 312/127; 312/313; 312/323; 312/349

(58) Field of Classification Search ..... 220/813, 220/558, 812, 345.4; 312/8.5, 127, 313, 312/321, 322, 323, 349
See application file for complete search history.

(56) References Cited

U.S. PATENT DOCUMENTS 1,975,806 A * 10/1934 Straubel ..... 220/558
1,983,573 A * 12/1934 Straubel ..... 220/558
2,534,784 A * 12/1950 Maxwell ..... 355/85
2,608,456 A * 8/1952 Barth ..... 312/8.5
2,648,583 A * 8/1953 Teach ..... 312/136
4,258,967 A * 3/1981 Boudreau ..... 312/322
4,476,988 A 10/1984 Tanner
6,405,861 B1 * 6/2002 Siler et al. ..... 206/317
6,460,294 B1 10/2002 Harkins
6,695,165 B2 * 2/2004 Park ..... 220/812
7,055,217 B2 6/2006 Nishihara
7,583,989 B2 9/2009 Lee et al.
7,900,322 B2 3/2011 Doring et al.

* cited by examiner

*Primary Examiner* — Mickey Yu
*Assistant Examiner* — Niki Eloshway
(74) *Attorney, Agent, or Firm* — Gerhard W. Thielman, Esq.

(57) ABSTRACT

A mechanism is provided for connecting a door to a container. The door provides and restricts access to a chamber of the container in respective open and closed positions. The mechanism includes, at each corresponding lateral side of the container and the door, a rail mounted to the container, an elbow, and first and second linkage arms. The rail aligns along a fore-and-aft direction so that the elbow slides along that direction. The elbow has vertical and axial members. The axial member connects to the rail. The first linkage arm includes first, second and third joints that pivotably connect respectively to the vertical member, to the container, and to the door. The second linkage arm includes fourth and fifth joints that pivotably connect respectively to the door and to the container. The linkage arms are disposed to avoid lateral obstruction beyond the door in the open position.

3 Claims, 12 Drawing Sheets

SLIDER-HINGE DOOR

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

CROSS REFERENCE TO RELATED APPLICATION

The invention is related to and incorporates by reference in its entirety an application for U.S. Patent titled "Ammunition Stowage Magazine" and assigned application Ser. No. 13/068,909.

BACKGROUND

The invention relates generally to slider-hinge doors. In particular, this invention relates to door-hinge mechanisms that provide a workspace on the door in its opened position.

The United States Navy has commissioned two class prototypes for a Littoral Combat Ship (LCS) intended for close shore fire support. In particular, the lead ships for these classes are the steel planing monohull U.S.S. Freedom (LCS-1) designed by Lockheed Martin, and the aluminum trimaran U.S.S. Independence (LCS-2) designed by General Dynamics. Both classes can be reconfigured with interchangeable weapons modules for select plug-and-fight missions. Follow-on ships in the Freedom class include U.S.S. Fort Worth (LCS-3), U.S.S. Milwaukee (LCS-5) and U.S.S. Detroit (LCS-7). Follow-on ships in the Independence class include U.S.S. Coronado (LCS-4), U.S.S. Jackson (LCS-6) and U.S.S. Montgomery (LCS-8).

The Gun Mission Module (GMM) as an example for the surface warfare module package includes two turret-mounted, axis-stabilized chain guns that can fire up to 200 rounds per minute of 30×173 mm ammunition, and can hold 800 rounds. Uniformed Navy personnel operate in highly confined spaces, including below deck. The GMM chain gun protrudes above deck from a module cover, below which personnel can supply ammunition from storage containers. Conventionally, such containers are disposed in a location requiring such ammunition either to be linked together absent an adequate platform and/or to be carried to the combat firing platform some significant distance from its stowage location.

SUMMARY

Conventional doors for ammunition magazines yield disadvantages, such as lateral workspace obstruction, addressed by various exemplary embodiments of the present invention. In particular, these embodiments provide a mechanism for connecting a door to a container. The door provides and restricts access to a chamber of the container in respective open and closed positions. The mechanism includes, at each corresponding lateral side of the container and the door, a rail mounted to the container, an elbow, and first and second linkage arms.

The rail aligns along a fore-and-aft direction so that the elbow slides along that direction. The elbow has vertical and axial members. The axial member connects to the rail. The first linkage arm includes first, second and third joints that pivotably connect respectively to the vertical member, to the container, and to the door. The second linkage arm includes fourth and fifth joints that pivotably connect respectively to the door and to the container. The linkage arms are disposed to avoid lateral obstruction beyond the door in the open position.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1A:
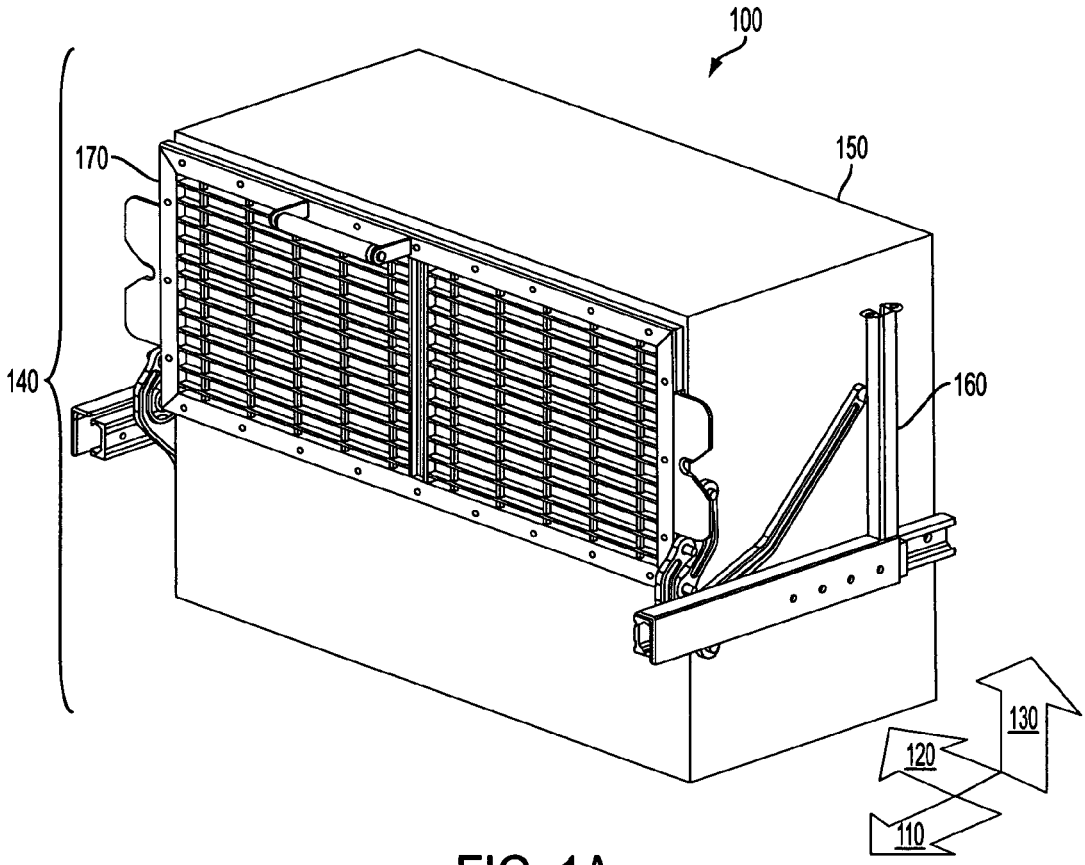
FIGS. 1A and 1B are isometric assembly views of an ammunition magazine module.
Figure 1B:
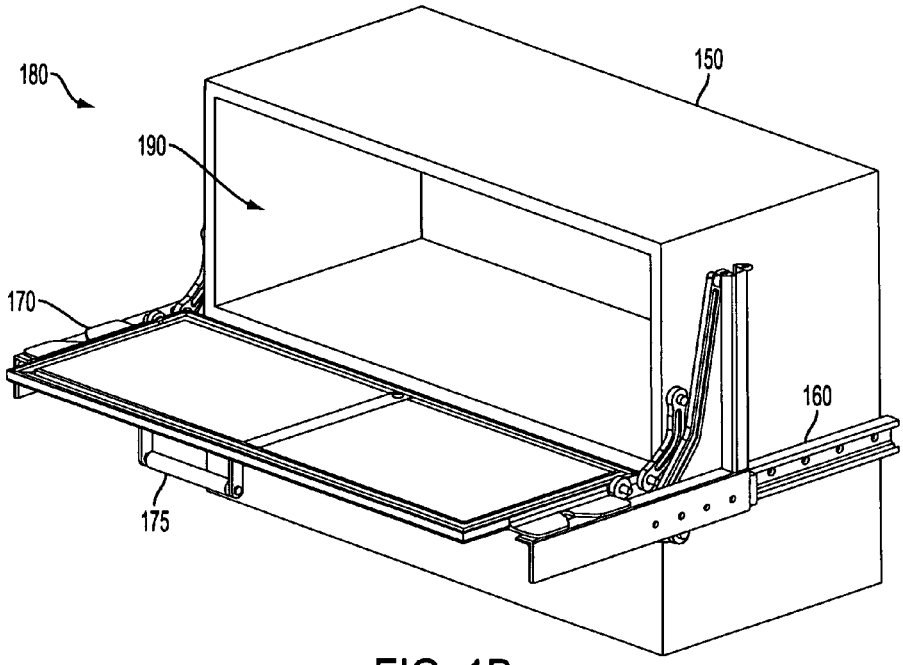

FIG. 1A shows an isometric assembly view 100 of an ammunition magazine module in closed configuration. For orientation convention, depth, width and height can be denoted by arrows for axial 110 (aft-to-fore), lateral 120 (port-to-starboard) and vertical 130 (bottom-to-top) directions. The magazine 140 includes a rectangular container 150 flanked by a hinge-rail assembly 160 and accessible by a hatch or door 170 accessible by a handle 175. FIG. 1B shows an isometric assembly view 180 of the modular ammunition magazine 140 in open configuration as indicated with the door 170 pulled down by the handle 175 to reveal an internal storage chamber 190.

The door 170 represents a front-load configuration that travels axially fore and aft. Artisans of ordinary skill will recognize that this movement can also apply to a top-load configuration for a door that travels vertically up and down. Depending on orientation, the terms "fore" and "aft" can be interpreted as directions of door's motion for either opening configuration that are substantially parallel to the sides of the container 150.

Figure 2A:
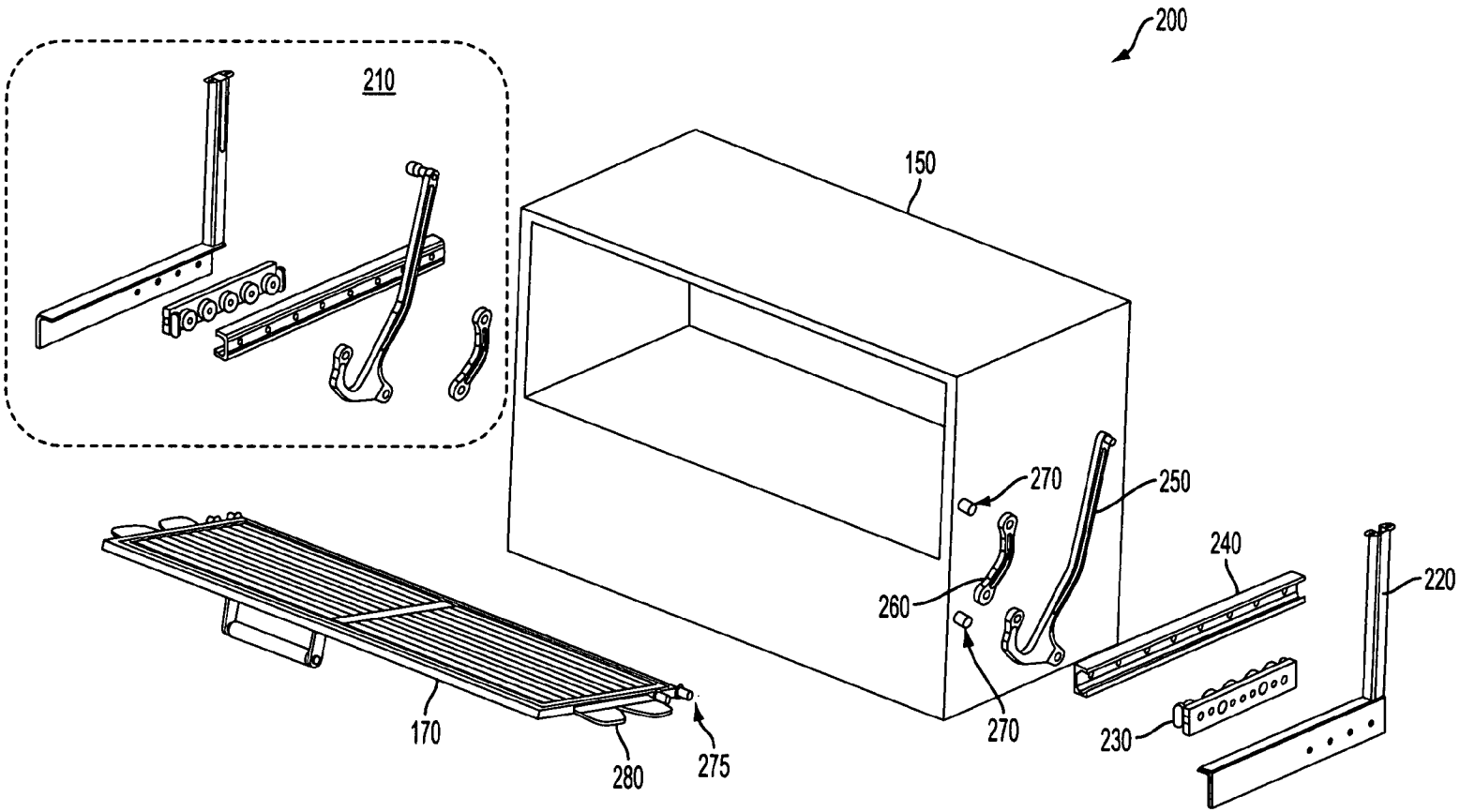
FIG. 2A is an isometric exploded view of components for the ammunition magazine module.
Figure 2B:
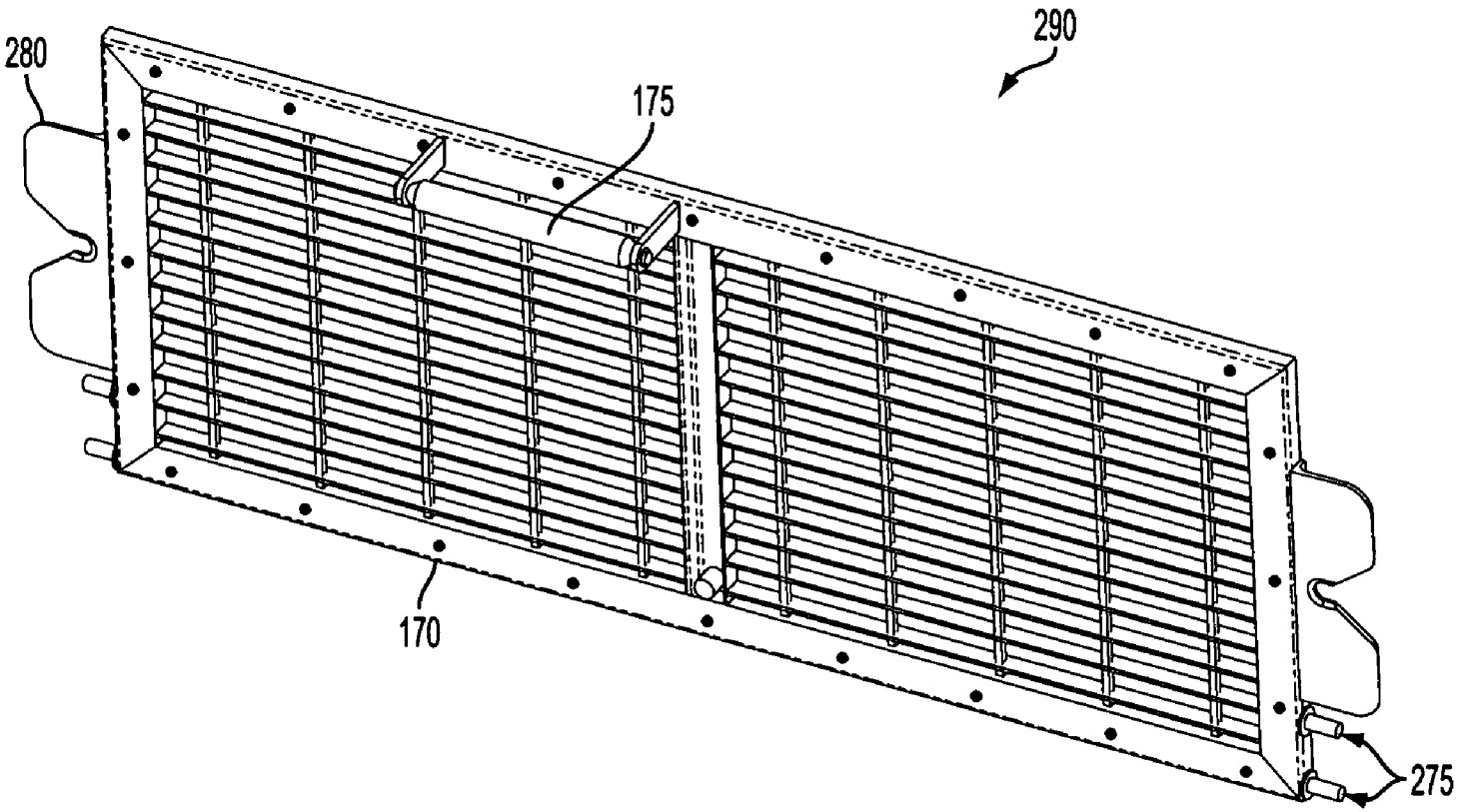
FIG. 2B is an isometric component view of a door panel.

FIG. 2A shows an isometric exploded view 200 of components for the magazine module 140. The hinge-rail assembly 160 comprises armature components 210 mounted to the external port and starboard sides of the container 150. The components 210 include an elbow bar 220, a slider 230, a slide rail 240, a first three-point hinge 250, and a second two-point hinge 260. Button pins 270 protrude laterally from the container 150 on which the first hinge 250 and second 260 hinge pivot. The elbow bar 220 attaches to the slider 230 to traverse fore and aft along the slide rail 240. Button pins 275 and protruding flanges 280 extend from the lateral ends of the door 170. FIG. 2B shows an isometric view 290 of the door 170. The upper and lower pins 270 insert into ends of the respective second and first hinges 260 and 250. The upper and lower pins 275 insert into ends of the respective first and second hinges 250 and 260.

Figure 3B:
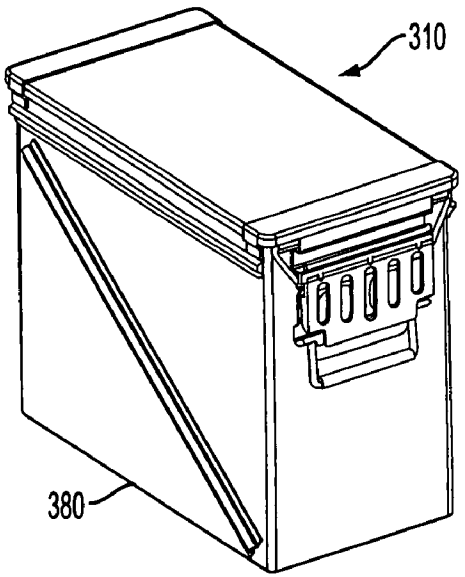
FIGS. 3A and 3B are respective isometric views of a magazine frame and an ammunition can.
Figure 3A:
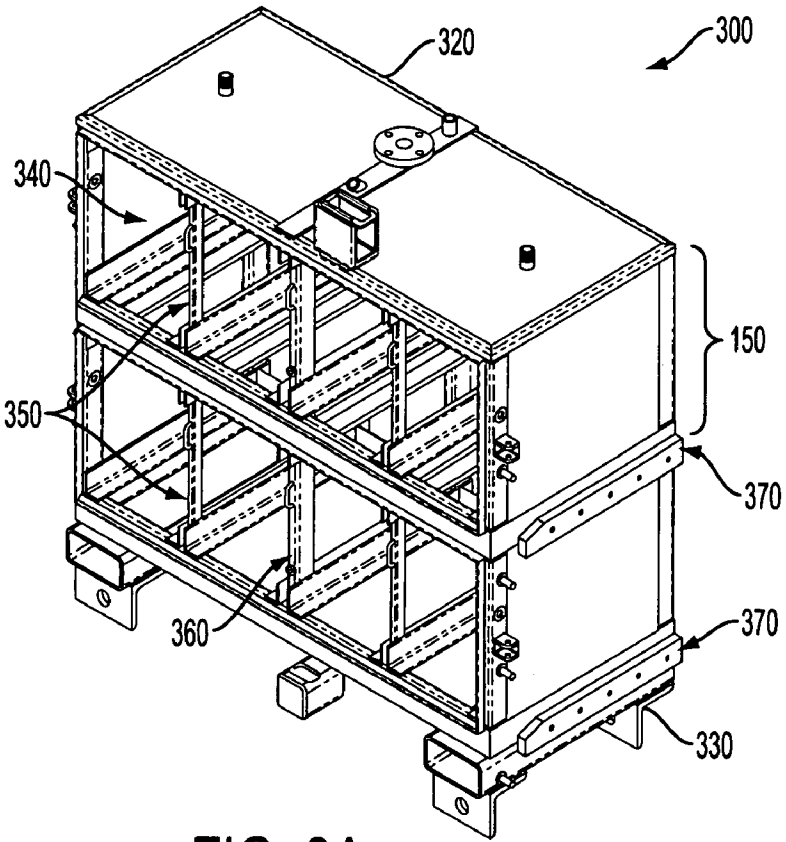

FIG. 3A shows an isometric view 300 of the magazine's framework, and FIG. 3B shows an isometric view 310 of an ammunition can for 30 mm rounds. The magazine includes a steel container frame 320 comprising a stack pair of containers 150 mounted on a floor base 330 shown within substantially the same directional orientation as container assembly view 100. The frame 320 defines interior spaces 340 separated by dividers 350 and 360. A strut 370 attaching to each lateral side of the frame 320 provides mounts for the rail 240.

A typical 30 mm ammunition can 380 slides into one space 340 for stowage. For the container frame shown 320, the spaces 340 can hold a total of eight cans 380. Each can 380 holds two belts of fifteen linked 30 mm rounds and weighs about 80 pounds-mass. Alternate designs can provide for more or fewer ammunition containers of sundry dimensions.

Figure 4B:
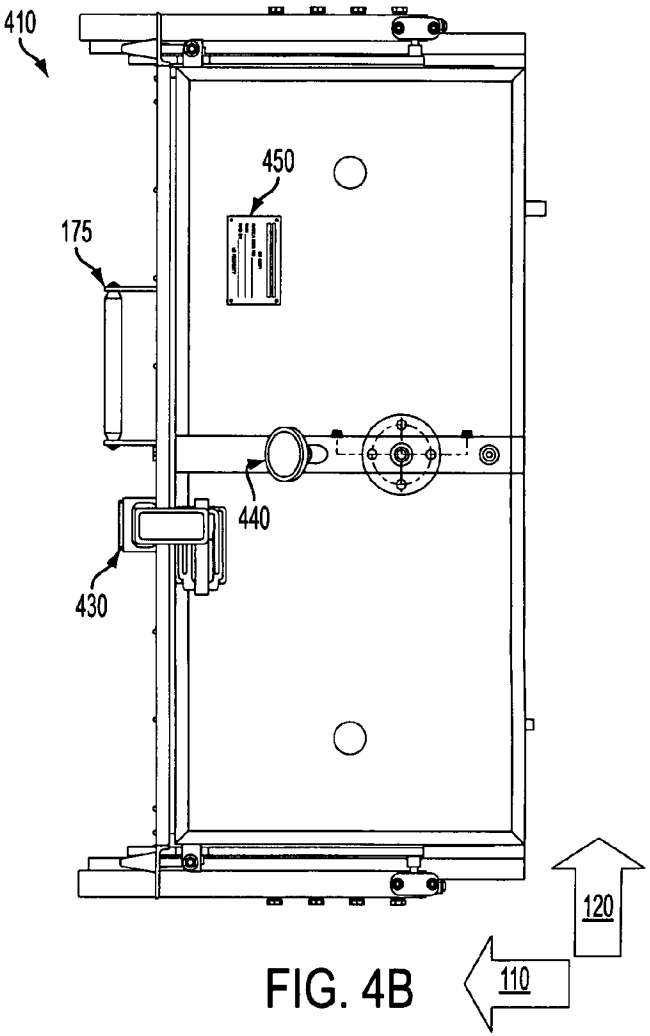
FIGS. 4A and 4B are respectively isometric and plan assembly views of a ready service magazine.
Figure 4A:
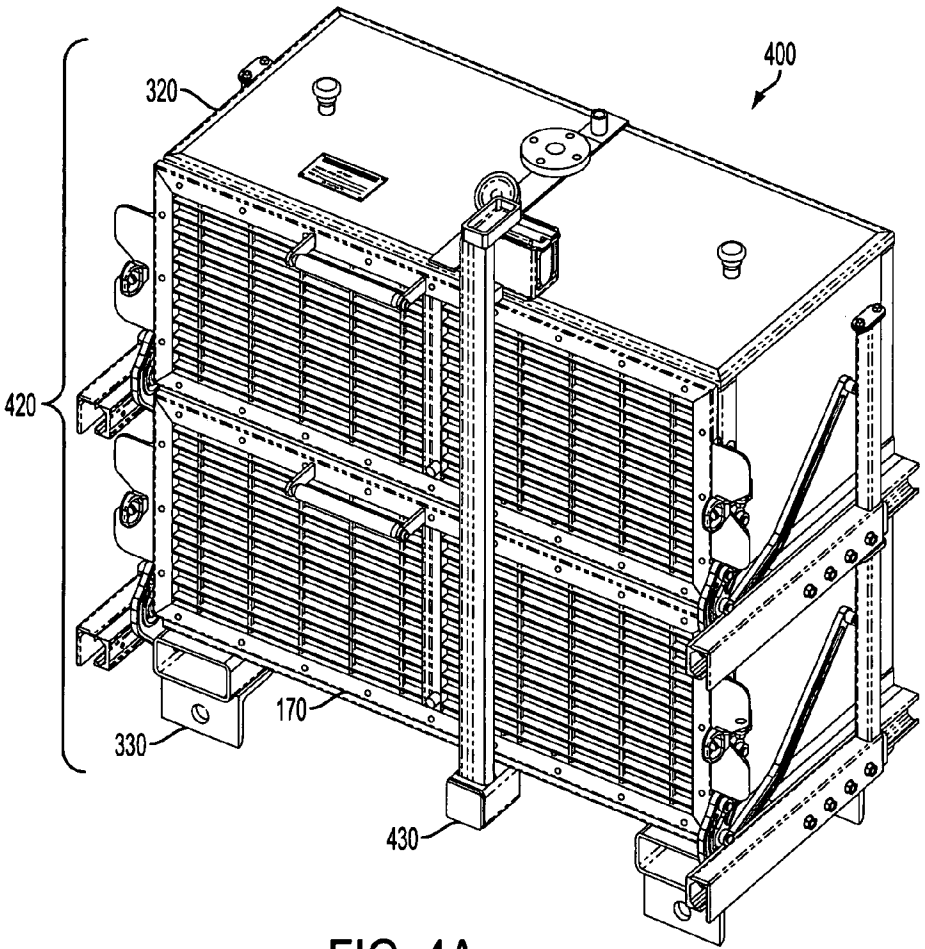

FIGS. 4A and 4B respectively show an isometric assembly view 400 and a plan assembly view 410 of a modular Ready Service Magazine 420 for ammunition stowage. A pair of upper and lower containers 150 stacks vertically together as the frame 320 onto and above the base 330. A security bar 430 locks the doors 170 in the closed position when not in use to inhibit unauthorized opening, particularly from sudden lateral ship movement.

Typical dimensions for the magazine 420 include length (along the lateral direction 120) of 44.0 inches, height (vertical direction 130) of 37.0 inches and width (axial direction 110) of 20.0 inches. The door 170 has corresponding length, width and thickness of 42.75 inches, 15.75 inches and ⅞ inch with a weight of 44 pounds-mass. The door's steel panel surface incorporates a perpendicular mesh of steel strips for structural support of ammunition disposed thereon. Artisans of ordinary skill will recognize that these dimensions are exemplary only and not limiting.

A thermometer 440 above the upper container 150 monitors temperature of the magazine's environment within the spaces 340. A label plate 450 provides appropriate identification of the magazine 320 and its contents. The magazine 420 incorporates features suitable for both an ammunition magazine (e.g., provisions for accessible workspace, thermal insulation, ventilation, and a sprinkling system) and a storage locker (e.g., possession of minimal footprint, and securable access doors).

Figure 5:
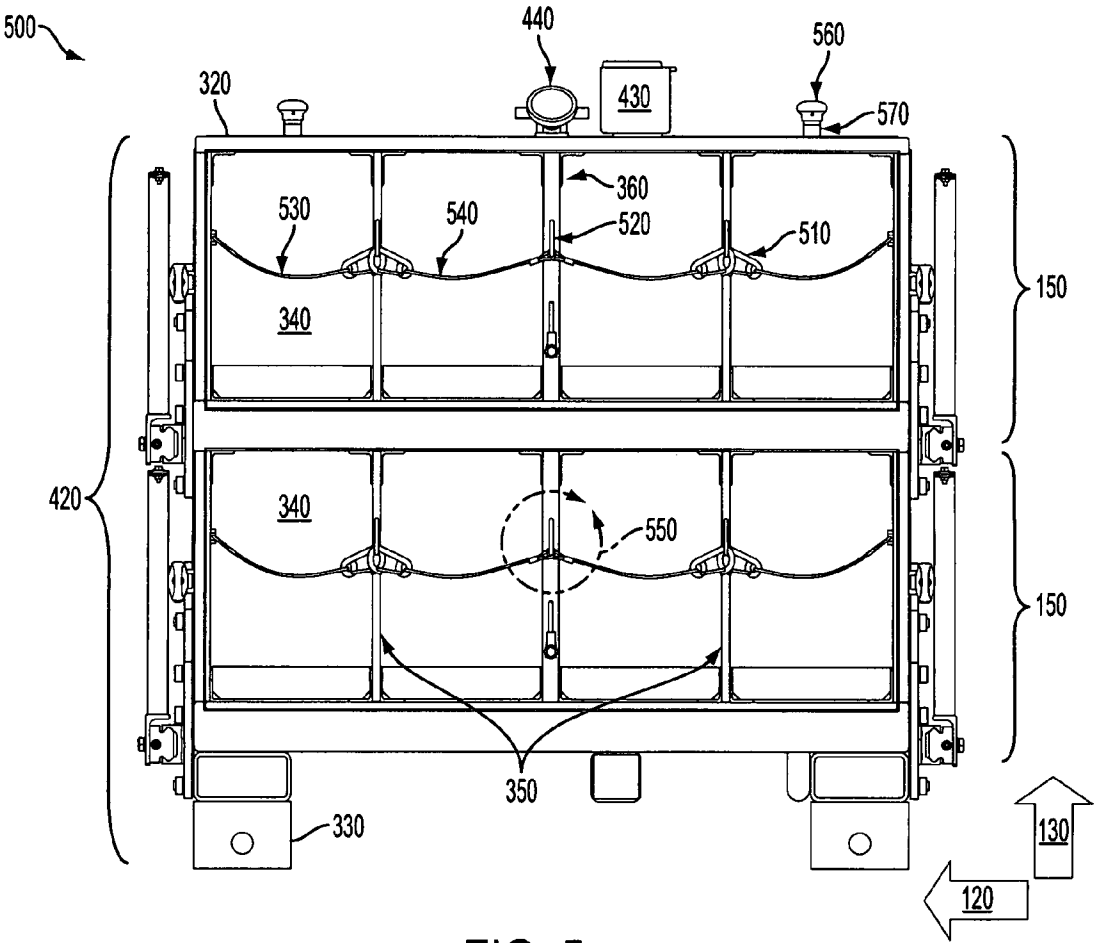
FIG. 5 is an elevation assembly view of the ready service magazine.

FIG. 5 shows an elevation assembly view 500 of the magazine 420 from the fore end with the doors 170 removed. Each container 150 includes a hanger guide 510 and a hook eyelet 520 to secure outer and inner retaining lanyards 530, 540. The eyelet 520 includes a detail view 550 described below. The lanyards 530, 540 provide restraints for the can 380 from crashing or slamming into the operating sailor as the ship rolls or pitches at sea while the door 170 remains open. A sprinkler-valve 560 supported by a column 570 attaches to the top of the magazine 420 for supplying fire retardant (e.g., water) in response to combustion, or else ventilation in the event of pressure from gas accumulation. The magazine 420 may also be equipped with sprinklers or alternate fire suppressant systems to retard blazes therein.

Figure 6B:
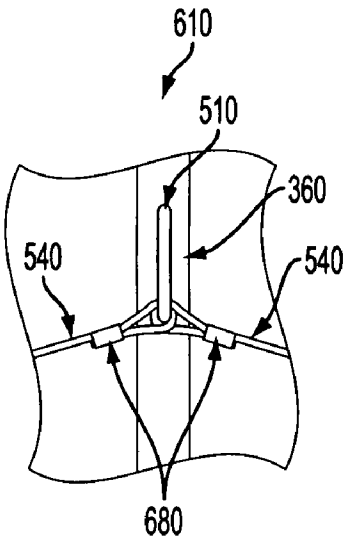
FIGS. 6A and 6B are elevation detail views of components of the ready service magazine.
Figure 6A:
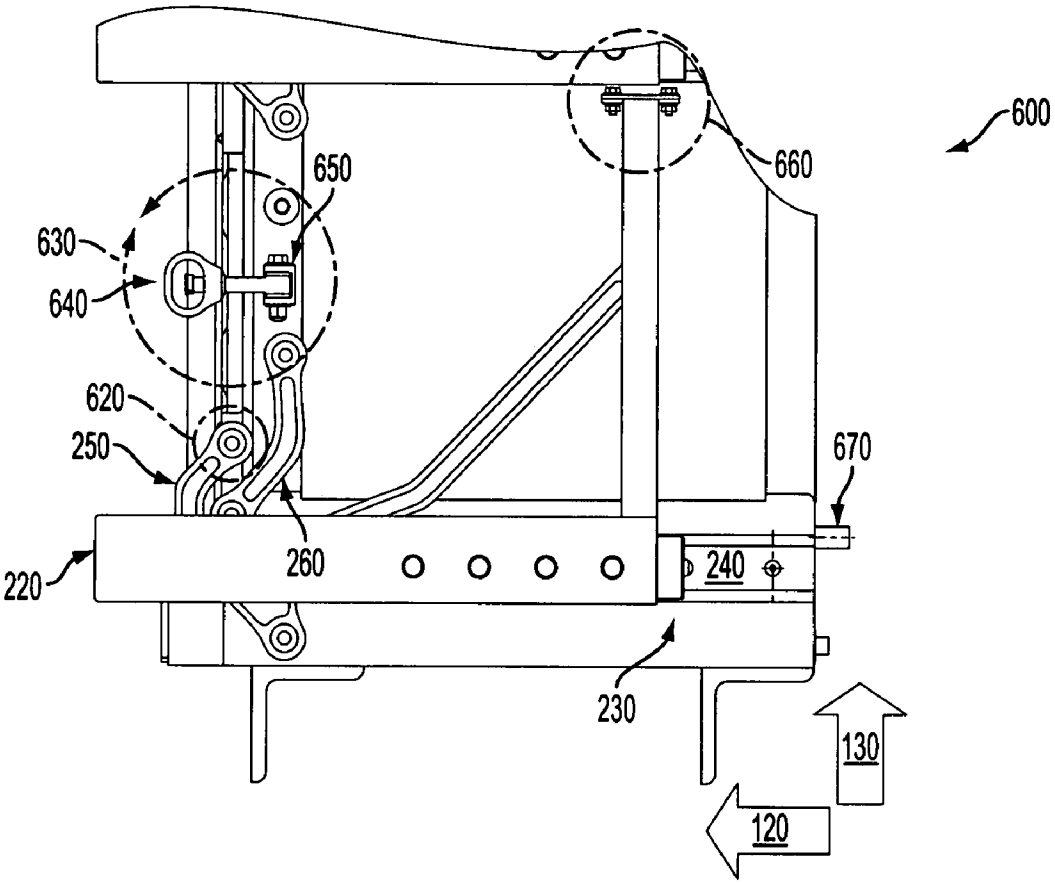

FIGS. 6A and 6B show elevation detail views 600 and 610 of components related to the hinge components 210 and the eyelet 520. The view 600 shows a lateral side of the magazine 420 from starboard looking port. The view 610 shows the front of the magazine 320 from the front looking aft. In particular, the first hinge 250 features a pivot joint 620 connecting the first hinge 250 to the door 170 at the upper button pin 275. Rollers on the slider 230 enable the elbow 220 to axially translate along the rail 240. These motions open the door 170 from its closed position against the container.

A detail features a dog bolt assembly 630 including a rotatable handle 640 that can pivots on a swing hinge 650 attached to either side of each container 150. With the door 170 closed, the handle 640 latches between the flanges 280 to preclude opening, being further secured by the security bar 430. Note that the handle 640 can rotate on either or both longitudinal and hinge axes for quick release or engagement. The dog-latch assembly 630 latches the flanges 280 on the door 170. The swing hinge 650 enables the handle 640 to be swung laterally away from the flanges 280 to release the door 170 for opening. The elbow bar 220 features an end cap 660. A grounding boss 670 provides an attachment to electrically ground each module 140. The eyelet 520 connects the inner lanyards 540 connected by the lanyard end retainers 680.

Conventional techniques for supporting a drop-door involve top surface hinges or cables as commonly used in hatches for ovens or troop trans-ports to augment hinges that may support the door as a resting surface. Other conventional techniques involve manually pulling out a slider to support the drop door. Typically, these flanking sliders and cables impede lateral access beyond the door's opened surface, thereby blocking transport of items, such as ammunition rounds.

In various exemplary embodiments, the door 170 attaches at the lower and upper button pins 275 respectively to the second hinge 260 and the first hinge 250, the latter demarcated as the joint 620. Both hinges 260 and 250 connect to the container 150 respectively at the upper and lower button pins 270 to form a four-bar linkage assembly on each of the port and starboard sides. The slide rail 240 attaches to the container 150, which houses the slider 230. The elbow bar 220 attaches to the slider 230.

The top of the first hinge 250 is equipped with a roller caster that rides inside a vertical slot of the elbow bar 220 forms a scotch yoke between the slide rail 240, the elbow bar 220 and the slider 230. The hinge-rail assembly 160 provides the advantages of providing a work surface that can be completely unobtrusive on both the top and at the port and starboard sides. The hinge-rail assembly 160 also enables the automatic reposition of the sliders 230 based purely on motion of the door 170, such as by a scotch yoke (for converting between circular and linear motions), without the use of cables or gears.

Figure 7A:
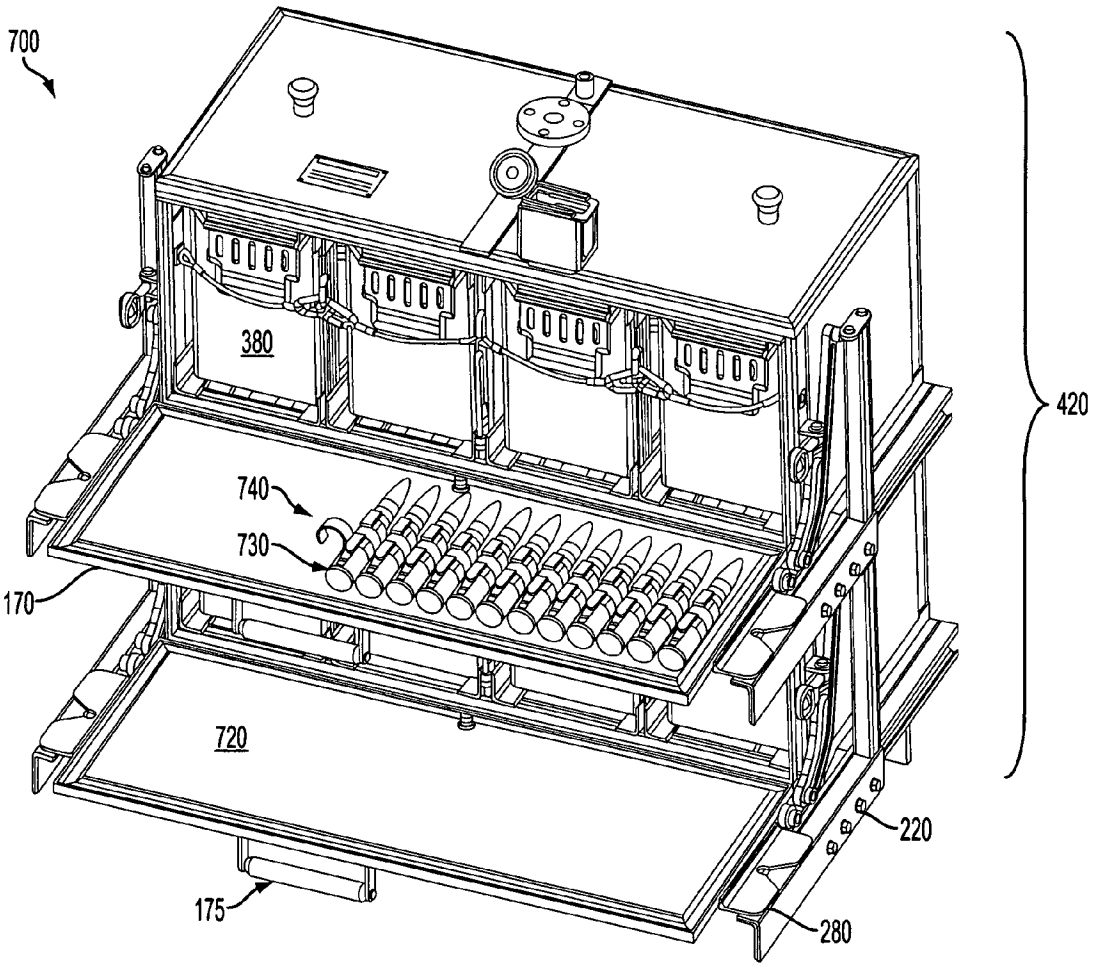
FIGS. 7A and 7B are respectively isometric and elevation assembly views of the ready service magazine.
Figure 7B:
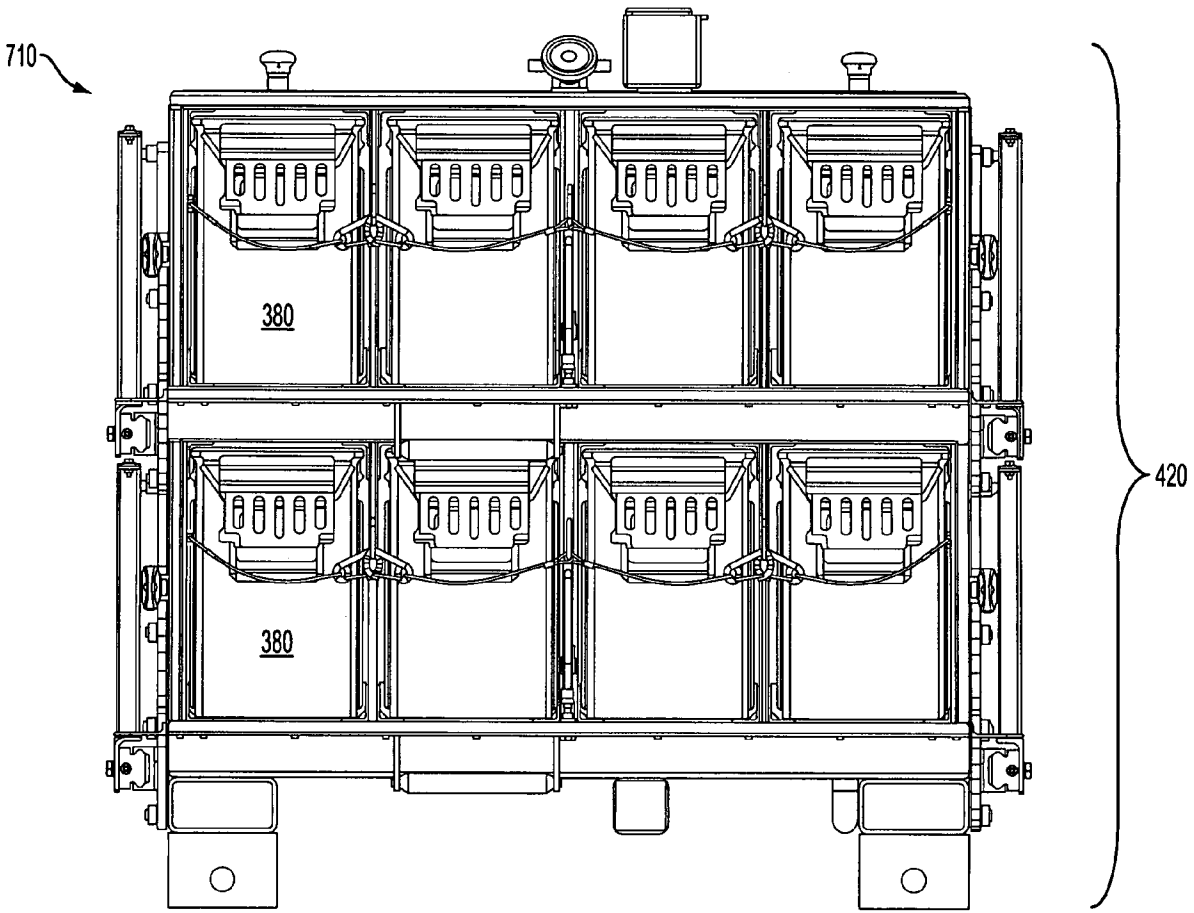

FIGS. 7A and 7B respectively show an isometric assembly view 700 and an elevation assembly view 710 of the magazine 420 illustrated with the doors 170 hinged open to reveal the cans 380 restrained by the lanyards 530 and 540. The flanges 280 on each door 170 rest on the elbow bars 220 to provide a flat table work surface 720 in front of the magazine 420. The door's surface 720 supports 30 mm ammunition rounds 730 concatenated together for feeding into the chain gun by metal links 740 that may be assembled by sailors. For the configuration produced, the door 170 supported by the elbow 120 can support a load exceeding 80 pounds-mass.

Figure 8:
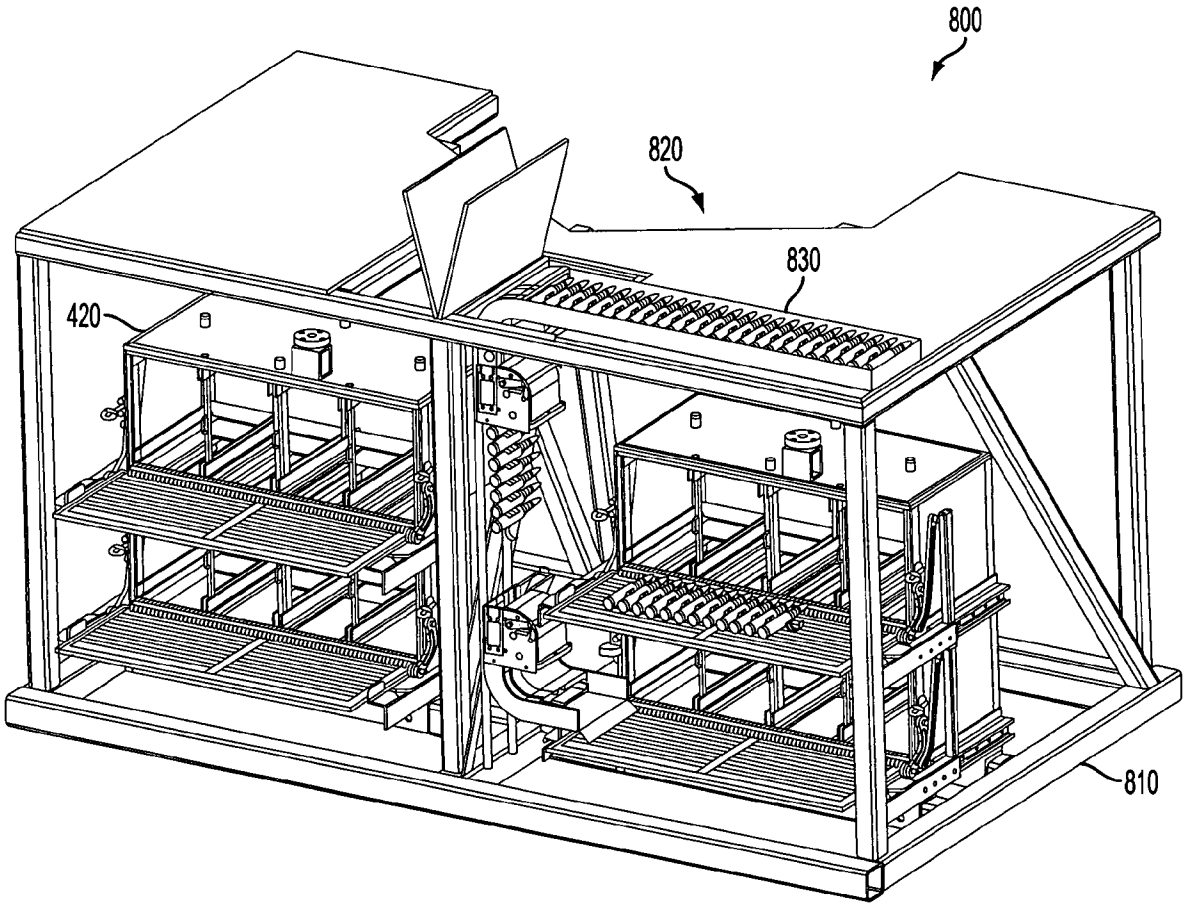
FIG. 8 is an isometric assembly view of an LCS GMM stowage frame.
Figure 9B:
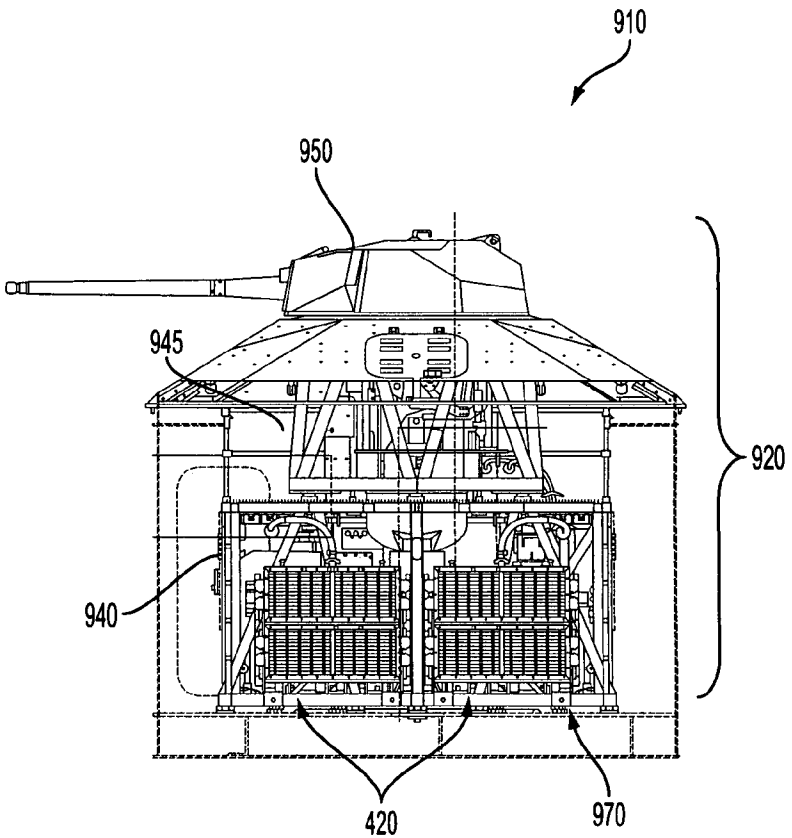
FIGS. 9A and 9B are isometric assembly and exploded views of the LCS GMM.
Figure 9A:
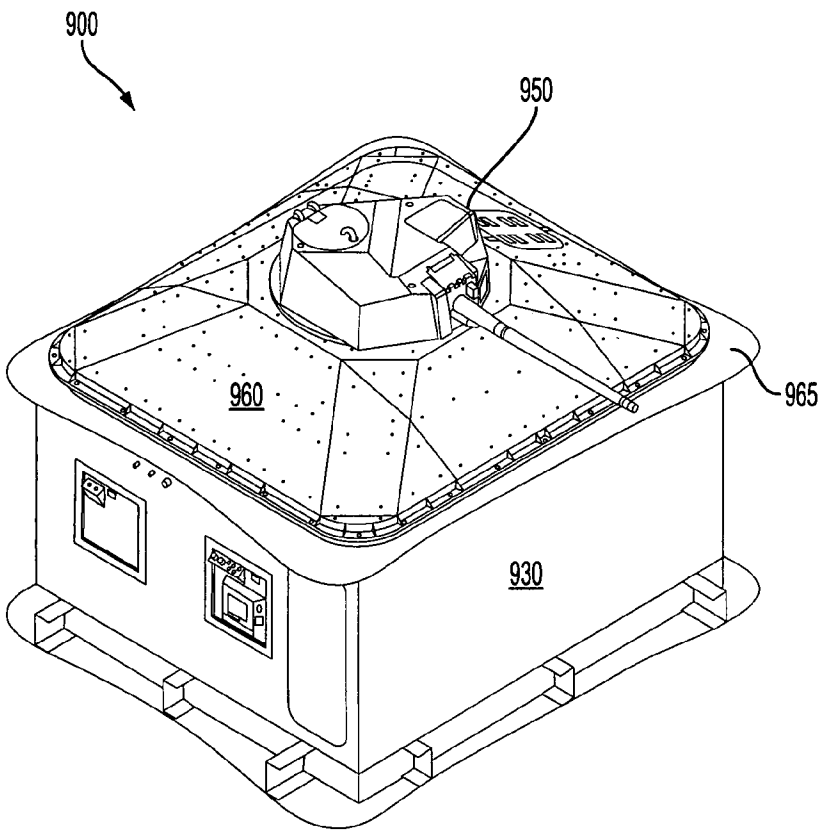

FIG. 8 shows an isometric assembly view 800 of a pair of magazines 420 within a ship hold for containing the Gun Mission Module (GMM). The magazines 420 are contained within and covered by a storage frame 810 that includes a cutout region 820 for the gun platform, as well as an ammunition feed chute 830 to receive rounds 730 stored in the cans 380 within the spaces 310. FIGS. 9A and 9B respectively show an isometric assembly view 900 and an elevation assembly view 910 of a GMM 920 installed in a ship hold 930.

The GMM 920 includes a mid-foundation frame 940 and an upper mount frame 945 on which the turret 950 is disposed. The frames 940 and 945 are covered by a gun cover 960 connected to the hold 930 by a barbette 965. The mid frame 940 rests on a foundation frame 970. The storage frame 810 external to the mid frame 940, as demarcated by the cutout 820, contain magazines 420 on the foundation frame 970.

Various exemplary embodiments of the ammunition magazine 420 can be employed as an LCS Gun Mission Module (GMM) Ready Service Magazine 420 in compliance with NAVSEA OP-4. The nature of the modular weapon system, such as the GMM, poses unique requirements on the ammo storage area, which must satisfy many requirements of both a traditional Ready Service Magazine and a Ready Service Locker. The exemplary Ready Service Magazine 420 combines elements of both the magazine and locker to provide a a working space, similar to a traditional magazine, in the form of fold down doors for linking and de-linking ammo, while maintaining a locker sized footprint located in proximity to the weapon platform to be served.

Some missile storage rooms containing automatic handling equipment also serve as conventional primary magazines. Such a magazine constitutes actually a walk-in chamber with many requirements that are non-applicable for a modular weapon system including such features such as thermal insulation.

Conventional lockers are often provided for stowage of special types of ammunition and ammunition components such as detonators, pyrotechnics, and chemicals. These are frequently located on the weather deck to be conveniently accessible for the weapon to be served. White sunshields may be required when such lockers face exposure to external elements. Various requirements may be imposed depending on usage: NAVSEASYSCOM Drawing 804-1360106 for topside lockers attached to a deck or bulkhead, NAVSHIPS Drawing 804-6397302 for stowage of thermite grenades.

Lockers for pyrotechnic and incendiary ammunition, such as parachute flares and thermite grenades, include manual jettison capability in case of fire in the vicinity. Being located below the weather deck, the exemplary Ready Service Magazine 420 does not require the sunshield.

A positive locking device, such as the security bar 430 can be provided to prevent inadvertent actuation of any jettison mechanism installed in the magazine 420. The support arm for the armature components 210 enable avoidance of contact with intended contents when the doors 170 are closed.

The LCS GMM ready service magazine 420, divided into upper and lower sections with each containing four ammunition cans 380, can be operated as follows: An operator (e.g., sailor) unlocks the security bar 430 from the magazine 420. The operator opens the door 170 by grasping the handle 175 to pull forward. The operator unlatches the retaining lanyards 530 and/or 540 for the compartment to be accessed. The operator pulls an ammunition can 380 forward onto the work surface 720 of the door 170. The operator pulls the ammunition can 380 and connects rounds 730 together by associated links 740 on the door's work surface 720. The magazine 420 has the advantage of providing an unobstructed working surface 720 and stowage spaces 340 in a small footprint necessary for a modular system.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A mechanism connecting a door to a container bounded by a pair of lateral walls, said door providing and restricting access to a chamber of said container in respective open and closed positions so as to pivotably open towards an axial fore-and-aft direction, said door terminating in a pair of edges that extend in a lateral direction across said pair of lateral walls, said mechanism comprising at each corresponding lateral wall of said container and a corresponding edge of said door:

upper and lower pivot pins disposed on the wall external to the chamber, said pins extending parallel in the lateral direction substantially perpendicular to the axial direction;

proximal and distal pivot pins disposed on the corresponding edge relative to the lateral axis and extending parallel thereto, the door being openable to swing on the lateral axis and translate along the axial direction to provide in the men position an operational surface parallel to the axial and lateral axes the mechanism disposed to being entirely behind, and below said surface for the door in the open position;

a rail mounting to said lateral wall of the container being aligned along the axial direction;

an elbow for sliding along said direction, said elbow having vertical and axial members, said axial member translatable connecting to said rail;

a first linkage arm having first, second and third joints pivotably connecting respectively to slide along said vertical member, to pivot on said lower pin of said lateral wall, and to said distal in of the edge; and a second linkage arm having fourth and fifth joints pivotably connecting respectively to said proximal pin of the edge and to the lateral wall, wherein said linkage arms are disposed to avoid lateral obstruction beyond said surface for the door in the open position.

2. The mechanism according to claim 1, wherein said axial member further includes a slider to translatably interface with said rail along the axial direction.

3. The mechanism according to claim 1, wherein the container further includes a pivotable latch and the door further includes a connector, such that said latch secures said connector for the door in the closed position.

* * * * *